US007232169B2

(12) United States Patent
Porter

(10) Patent No.: US 7,232,169 B2
(45) Date of Patent: Jun. 19, 2007

(54) BAG AND HANGER CARRYING GRIP

(76) Inventor: Fay Porter, 12900 Lake Ave., Suite 1621, Lakewood, OH (US) 44107

( * ) Notice: Subject to any disclaimer, the term of this patent is extended or adjusted under 35 U.S.C. 154(b) by 0 days.

(21) Appl. No.: 11/580,133

(22) Filed: Oct. 12, 2006

(65) Prior Publication Data

US 2007/0085360 A1 Apr. 19, 2007

Related U.S. Application Data

(60) Provisional application No. 60/817,166, filed on Jun. 28, 2006, provisional application No. 60/726,576, filed on Oct. 14, 2005.

(51) Int. Cl.
*A45F 5/10* (2006.01)
*B65D 33/06* (2006.01)

(52) U.S. Cl. ..... 294/137; 294/145; 294/171

(58) Field of Classification Search ..... 294/137, 294/145, 159, 171; 383/13, 25; D9/434, D9/455; 403/378, 379.3, 379.5, 379.6
See application file for complete search history.

(56) References Cited

U.S. PATENT DOCUMENTS

| | | | | | |
|---|---|---|---|---|---|
| 1,691,467 | A | | 11/1928 | Carver | |
| 2,215,116 | A | | 9/1940 | Crary | |
| 2,287,329 | A | | 6/1942 | Santa Maria et al. | |
| 2,394,050 | A | | 2/1946 | Goza | |
| 2,444,558 | A | | 7/1948 | Elliott | |
| 3,083,366 | A | * | 3/1963 | Franges | 294/171 |
| 3,353,852 | A | * | 11/1967 | Wood | 403/189 |
| 3,670,937 | A | * | 6/1972 | Bradshaw | 294/171 |
| 3,680,752 | A | * | 8/1972 | Wilson | 294/171 |
| 4,262,385 | A | | 4/1981 | Norman | |
| 4,590,640 | A | | 5/1986 | Enersen | |
| 4,796,940 | A | | 1/1989 | Rimland | |
| 4,846,519 | A | | 7/1989 | Leonard | |
| 4,902,060 | A | * | 2/1990 | Nobakht | 294/171 |
| 4,923,235 | A | * | 5/1990 | Stewart | 294/141 |
| 4,982,989 | A | | 1/1991 | Sweeny | |
| 5,005,891 | A | | 4/1991 | Lunsford | |
| 5,199,758 | A | | 4/1993 | Howell | |
| 5,257,845 | A | | 11/1993 | McConnell | |
| 5,368,393 | A | * | 11/1994 | Normann | 383/13 |
| D367,817 | S | | 3/1996 | Halpin et al. | |
| 5,509,708 | A | * | 4/1996 | Nathan | 294/141 |
| D369,549 | S | * | 5/1996 | Meyers et al. | D9/434 |

(Continued)

FOREIGN PATENT DOCUMENTS

| | | | | |
|---|---|---|---|---|
| GB | 2 132 882 | * | 7/1984 | 294/171 |

*Primary Examiner*—Dean J. Kramer
(74) *Attorney, Agent, or Firm*—Calfee, Halter & Griswold LLP

(57) ABSTRACT

A bag carrying grip facilitates installation and removal of plastic bags in the grip and remains installed on the bags when the bags are not being carried. The carrying grip includes a rigid, generally tubular section having tapered ends and a slit running the length of the tubular section. Bags are inserted in the slit and can remain in the slit until the user removes them. The carrying grip may also include a pair of opposed hanger carrying openings that form a passage through which one or more hangers may be passed to ease in carrying the hangers. The hangers will remain installed in the grip until removed by the user.

21 Claims, 3 Drawing Sheets

U.S. PATENT DOCUMENTS 5,632,409 A 5/1997 Raghunanan
5,658,029 A 8/1997 Franko
5,722,117 A 3/1998 Nielsen
5,738,401 A * 4/1998 Fan ..... 294/171
5,803,522 A 9/1998 Lisbon
5,865,494 A 2/1999 Tipp
5,881,432 A 3/1999 Good
5,992,803 A 11/1999 LeRoux
5,996,180 A 12/1999 Eisenzopf
6,354,645 B2 3/2002 Bozlee
D456,264 S 4/2002 Lalande
6,719,342 B2 * 4/2004 Shinmoto et al. ..... 294/171
6,749,240 B1 6/2004 Burr et al.
2002/0116796 A1 8/2002 Wills
2003/0131447 A1 7/2003 Mikus
2005/0258661 A1 11/2005 Castro

* cited by examiner

BAG AND HANGER CARRYING GRIP

CROSS REFERENCE TO RELATED APPLICATIONS

This application claims the benefit of priority from U.S. Provisional Application Nos. 60/726,576 filed on Oct. 14, 2005 and 60/817,166 filed on Jun. 28, 2006.

TECHNICAL FIELD

The invention relates generally to the field of articles for personal assistance in carrying loads and more particularly to articles for assisting persons in carrying one or more bags with handles or handle openings and/or clothing hangers.

BACKGROUND OF THE INVENTION

While in the past the use of paper bags or sacks was common, increasingly, plastic bags are replacing paper bags in retail establishments. The plastic bags often include an integral handle formed by two opposing openings near the top of the bag. While plastic bags are stronger, lighter, and more impervious to weakening due to moisture, plastic bags can be less convenient for a number of reasons. For example, when the plastic bag is heavily loaded, the handle of the bag is pulled taut and takes on characteristics of a wire or string that is uncomfortable to carry. Since the plastic bag is so lightweight and flexible, it provides little or no support to the goods placed in the bag when the loaded bag is stored away for transport. Articles, such as cans or produce, are free to roll out of the bag, requiring the user to gather up the articles and reload the bags once the final destination is reached.

Bag handle carrying aids have been developed to address some of the above listed problems. For example, U.S. Pat. No. 5,005,891 to Lunsford concerns a bag handle carrying aid made up of a semi-rigid flexible material. The carrying aid includes a tab that is used to lock the carrying aid in place around the bag handles. Similarly, U.S. Pat. No. 4,796,940 to Rimland is directed to a disposable hand grip for plastic bags. The Rimland grip is also flexible and includes a locking mechanism to hold the grip in place.

SUMMARY

A rigid carrying grip facilitates installation and removal of plastic bags in the grip and remains installed on the bags when the bags are not being carried. The carrying grip is made up of a tubular section terminating at first and second ends. The tubular section includes a slit along its axial length between the first and second ends.

The first and/or second ends can be tapered to form an angled end surface on the tubular section. The angled end surface can form either an acute or obtuse angle with respect to the slit.

The tubular member can be made of any rigid material such as plastic, for example PVC pipe, and can have a circular or other shaped cross section. The carrying grip can include text or designs imprinted on the tubular section.

The tubular member may also include one or more hanger openings adapted to accept an open end of one or more clothing hangers.

The tubular member may have a thickness that is thinner than the slit so that one tubular member may be inserted into the slit of another tubular member to place them in a nesting relationship to one another.

These and other objects, advantages, and features of the exemplary embodiment of the invention are described in detail in conjunction with the accompanying drawings.

DETAILED DESCRIPTION

Figure 1:
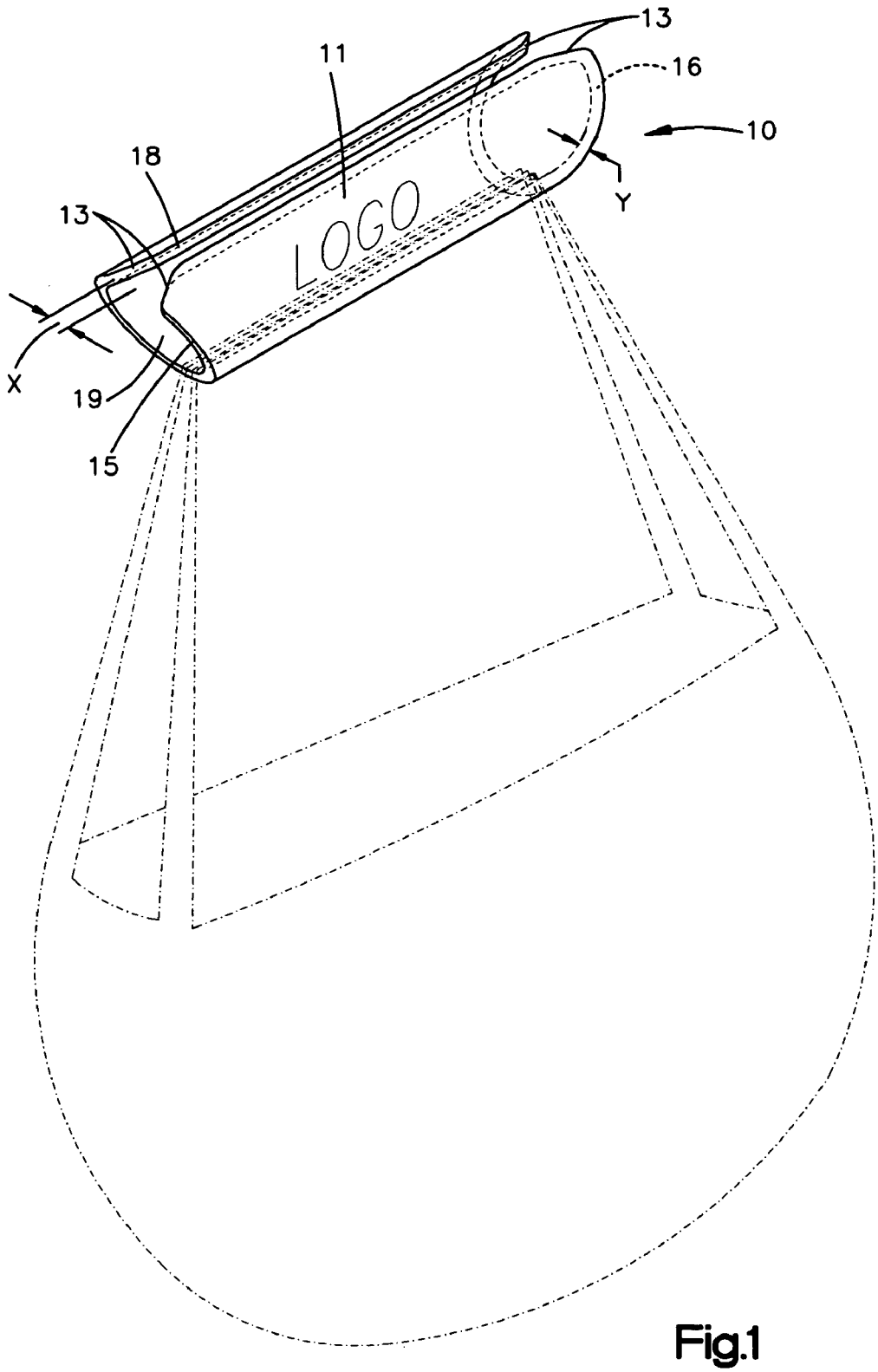
FIG. 1 is a perspective view of carrying grip constructed in accordance with one embodiment of the present invention with a plastic bag shown in phantom.

Referring to FIG. 1, a bag carrying grip 10 is shown in a perspective view with a bag illustrated in phantom. The grip 10 is made up of a tubular section 11 having a length of about four inches and an outer diameter of about one inch and an inner diameter of about ⅞ inch. The tubular section 11 terminates in end surfaces 15, 16 at either end. The tubular section 11 can be molded or machined from tube stock such as PVC plastic. While a tubular member having a circular cross section is shown herein, it will be apparent to one of skill in the art that a tubular section having a different cross sectional shape such as oval, square or triangular may also be employed. The tubular member has a wall thickness designated "y" in FIG. 1 which is less than ½ inch, preferably less than or equal to ⅛ inch. A slit 18 runs the length of the tubular section to provide an access opening for bags that are to be installed in the grip 10. The slit has a width "x" that is less than ½ inch, preferably less than or equal to ¼ inch. Other larger or smaller slit widths may be appropriate depending on the type of bags that are to be carried. A lead-in angled portion 13 can be present at one or more ends of the slit to assist the user in installing the bags. The end surfaces 15, 16 are tapered so that the end surfaces form an acute angle with respect to the slit 18. The edges of the tapered end surfaces 15, 16 and the slit 18 are smoothed to reduce the likelihood of damage to the plastic bag and provide additional comfort to the user. To install the grip 10 on plastic bags, the user need only insert both handles of the bag or bags to be carried into the slit 18. All of the installed bags can then be carried using the grip. In addition, the grip will remain installed on the bags even when the user sets the bags down, keeping the contents of the bag in the bag during transport. There is no grip locking mechanism that needs to be connected by the user. The grip may be washable when made of appropriate material, such as plastic.

Figure 2:
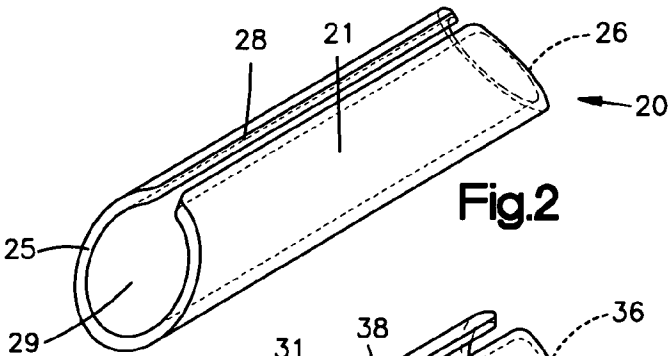
FIG. 2 is a perspective view of carrying grip constructed in accordance with another embodiment of the present invention.
Figure 3:
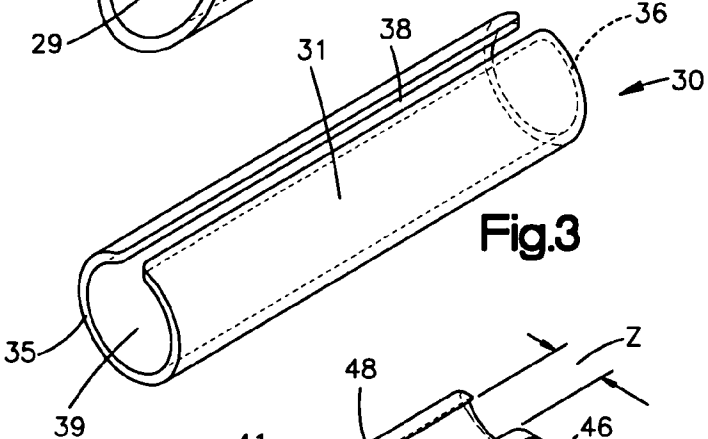
FIG. 3 is a perspective view of carrying grip constructed in accordance with another embodiment of the present invention.
Figure 4:
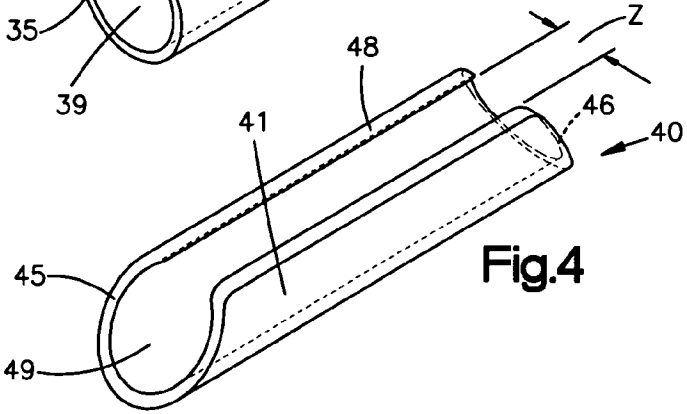
FIG. 4 is a perspective view of carrying grip constructed in accordance with another embodiment of the present invention.
Figure 5:
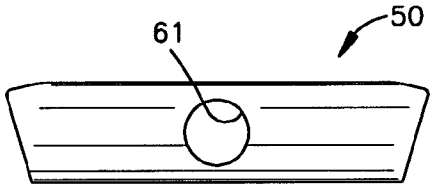
FIGS. 5-13 are side plan views of carrying grips that include hanger supporting openings according to various embodiments of the present invention.

FIGS. 2-4 illustrate various bag carrying grips. FIG. 2 shows a grip 20 that is made of a tubular section 21 of approximately the same length as the grip 10 in FIG. 1. End surfaces 25, 26 are tapered in the opposite direction from the end surfaces 15, 16 of the grip 10 of FIG. 1 so that the end surfaces 25, 26 form an obtuse angle with respect to the slit 28. FIG. 3 shows a grip 30 made of a tubular section 31 of the same length as the grips in FIGS. 1 and 2, but having end surfaces 35, 36 that are not tapered. FIG. 4 shows yet another carrying grip similar in geometry to that of FIG. 2 but having a slit 48 that is approximately ¼ inch across (this dimension is designated "z").

Figure 14:
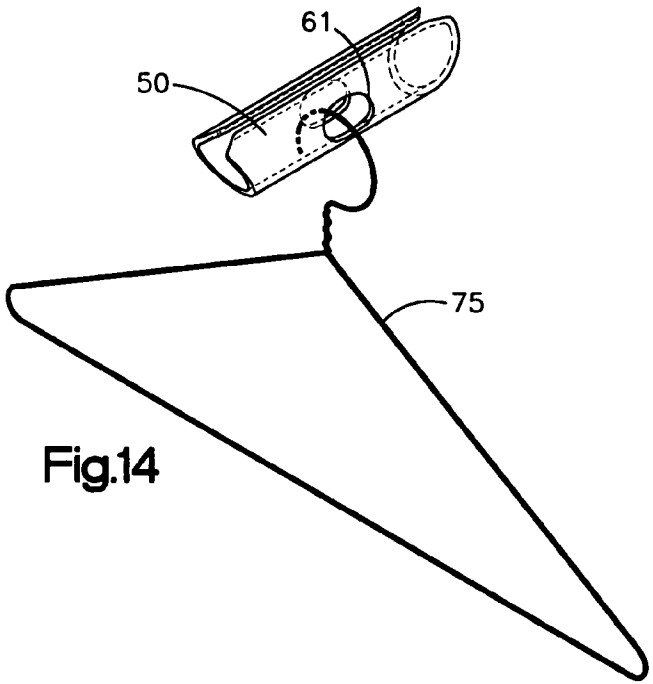
FIG. 14 is a perspective view of a carrying grip with a hanger installed in a hanger supporting opening.
Figure 6:
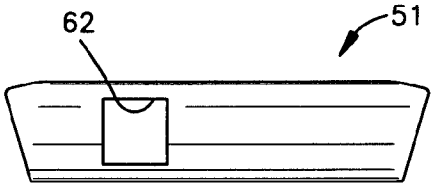
Figure 7:
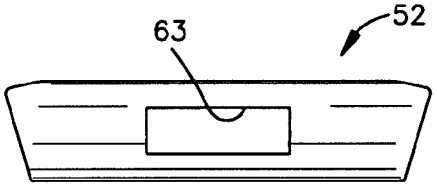
Figure 8:
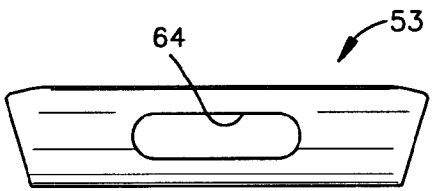
Figure 9:
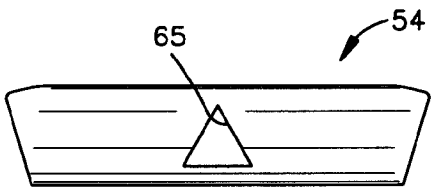
Figure 10:
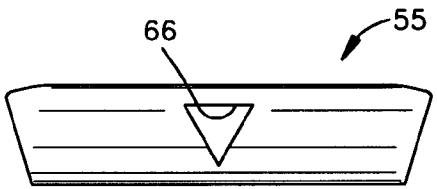
Figure 11:
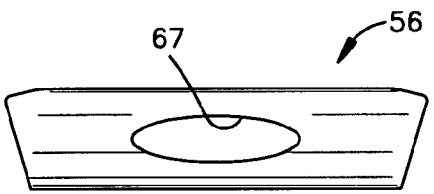
Figure 12:
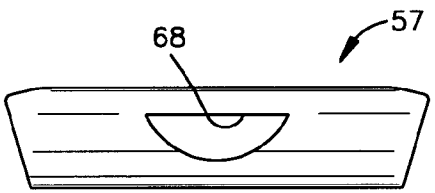
Figure 13:
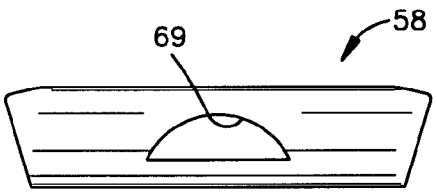

In addition to their utility in aiding customers in carrying bags from the store, the grips described herein can also be used as promotional items. As shown in FIG. 1, stickers or imprints bearing brands or logos can be placed on the grips and the grips can be sold or given away to provide brand visibility and garner goodwill amongst target consumers. The brands or logos can be placed on the grips using stickers or molded into the tubular sections during manufacturing FIGS. 5 through 13 illustrate bag carrying grips 50-58 that include the addition feature of a hanger supporting opening 61-69. The opening 61-69 is made of two symmetrical openings in opposing sides of the grip that line up to provide easy passage of an open end of one or a few hangers as shown in FIG. 14 in which a hanger 75 is inserted in a grip 50. As can be seen from the figures, the opening can have many shapes, such as circular, square, rectangular, elliptical, triangular, oval, or half moon. FIG. 6 in particular illustrates a grip 51 having a hanger supporting opening 62 that is offset from the center of the grip while FIGS. 5 and 7-13 show openings that are centered. The grip with the hanger supporting opening has the added benefit of being installable in most vehicle hanger hooks.

Figure 15:
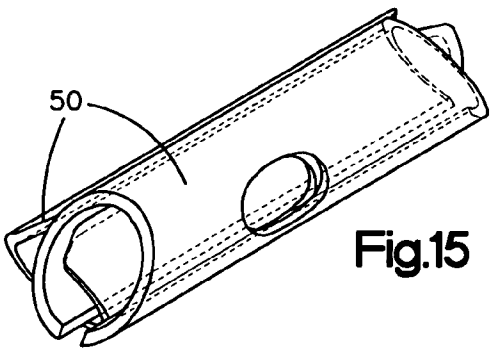
FIG. 15 is a perspective view of two carrying grips nested together.

FIG. 15 shows two grips 50 nested together for convenient storage. As can be seen from the FIG. 1*f* the grips are constructed of a material having a thickness less than the diameter of the slit, one grip can be inserted and slid through the slit of the other. It will be apparent to those of skill in the art that other shapes may also be advantageous.

It can be seen from the foregoing description that a rigid carrying grip facilitates installation and removal of plastic bags and hangers in the grip and remains installed on the bags and hangers when the bags and hangers are not being carried. Although the invention has been described with a certain degree of particularity, it should be understood that various changes can be made by those skilled in the art without departing from the spirit or scope of the invention as hereinafter claimed.

I claim:

1. A carrying grip comprising a rigid tubular section terminating at first and second ends, said tubular section further comprising a slit along its axial length between said first and second ends and wherein said tubular section includes a pair of hanger-accepting holes disposed on opposing sides of said tubular section to form a passage generally transverse to the tubular section through which a hanger may be passed, wherein said hanger accepting holes have a closed shape and wherein at least one of said first and second ends is tapered to form an angled end surface on said tubular section.

2. The carrying grip of claim 1 wherein said angled end surface forms an acute angle with respect to said slit.

3. The carrying grip of claim 1 wherein said angled end surface forms an obtuse angle with respect to said slit.

4. The carrying grip of claim 1 wherein said tubular member is made of plastic.

5. The carrying grip of claim 4 wherein said tubular member is a section of PVC pipe.

6. The carrying grip of claim 1 wherein said tubular member is approximately 4 inches in length.

7. The carrying grip of claim 1 wherein said slit is approximately ¼ inch across.

8. The carrying grip of claim 1 comprising text or design imprinted on the tubular section.

9. The carrying grip of claim 1 wherein said tubular section has a circular cross section.

10. The carrying grip of claim 1 further including a lead-in angle at one or more end portions of said slit.

11. The carrying grip of claim 1 wherein the hanger-accepting holes have a substantially identical size and shape.

12. The carrying grip of claim 1 wherein the hanger-accepting holes are generally circular in shape.

13. The carrying grip of claim 1 wherein the hanger-accepting holes are generally rectangular in shape.

14. The carrying grip of claim 1 wherein the hanger-accepting holes are generally square in shape.

15. The carrying grip of claim 1 wherein the hanger-accepting holes are generally elliptical in shape.

16. The carrying grip of claim 1 wherein the hanger-accepting holes are generally oval in shape.

17. The carrying grip of claim 1 wherein the hanger-accepting holes have a half moon shape.

18. The carrying grip of claim 1 wherein the slit has a slit width and wherein the tubular section has a thickness that does not exceed the slit width.

19. A carrying grip comprising:

a rigid tubular section terminating at first and second ends, said tubular section having a generally circular cross section and further comprising a slit along its axial length between said first and second ends;

wherein said first and second ends are tapered to form an angled end surface that forms an obtuse angle with respect to a terminating end of said slit;

and wherein the tubular section further includes a pair of spaced hanger-accepting holes in opposing sides of the tubular section that form a passage generally transverse to the tubular section through which a hanger may be passed, wherein said hanger accepting holes have a closed shape.

20. The carrying grip of claim 19 wherein the slit has a slit width and wherein the tubular section has a thickness that does not exceed the slit width.

21. The carrying grip of claim 19 further including a lead-in angle at one or more terminating ends of said slit.

* * * * *